US011095976B2

(12) United States Patent
Kim et al.

(10) Patent No.: US 11,095,976 B2
(45) Date of Patent: Aug. 17, 2021

(54) SOUND SYSTEM WITH AUTOMATICALLY ADJUSTABLE RELATIVE DRIVER ORIENTATION

(71) Applicant: Vizio, Inc., Irvine, CA (US)

(72) Inventors: Glen Gihong Kim, Anaheim, CA (US); Howard Shi-how Cheng, Swindon (GB)

(73) Assignee: Vizio, Inc., Irvine, CA (US)

( * ) Notice: Subject to any disclaimer, the term of this patent is extended or adjusted under 35 U.S.C. 154(b) by 0 days.

(21) Appl. No.: 16/737,647

(22) Filed: Jan. 8, 2020

(65) Prior Publication Data

US 2020/0221217 A1 Jul. 9, 2020

Related U.S. Application Data

(60) Provisional application No. 62/789,964, filed on Jan. 8, 2019.

(51) Int. Cl.
*H04R 1/40* (2006.01)
*H04R 1/02* (2006.01)

(52) U.S. Cl.
CPC ..... *H04R 1/403* (2013.01); *H04R 1/026* (2013.01); *H04R 2201/025* (2013.01); *H04R 2205/024* (2013.01)

(58) Field of Classification Search
CPC .. H04R 1/403; H04R 1/026; H04R 2201/025; H04R 2205/024
See application file for complete search history.

(56) References Cited

U.S. PATENT DOCUMENTS

| | | | | |
|---|---|---|---|---|
| 9,591,399 | B1 | 3/2017 | Wu et al. | |
| 9,648,440 | B2 | 5/2017 | Crockett et al. | |
| 9,693,162 | B2 * | 6/2017 | Yu | H04R 29/001 |
| 9,794,718 | B2 | 10/2017 | Crockett et al. | |
| 2008/0165979 | A1 | 7/2008 | Takumai | |
| 2017/0127211 | A1 | 5/2017 | Corckett et al. | |
| 2017/0208392 | A1 | 7/2017 | Smithers et al. | |
| 2019/0320283 | A1 * | 10/2019 | Crockett | H04S 7/308 |

FOREIGN PATENT DOCUMENTS

JP 4175420 B2 11/2008

OTHER PUBLICATIONS

English translation of JP 4175420 from Lexis Nexis Total Patent.

* cited by examiner

*Primary Examiner* — Andrew L Sniezek
(74) *Attorney, Agent, or Firm* — Hansen IP Law PLLC

(57) ABSTRACT

A sound system with a plurality of speakers is shown and described. The orientation of a second subset of the speakers is automatically adjustable relative to the orientation of a first subset of speakers. In certain examples, the system detects whether the audio signals it receives include up-firing content and adjusts the relative orientations when such content is provided. The sound system is also configured to calculate a desired degree of rotation for the speakers in the second subset based on the geometry of the room in which the sound system is located and the location of the listener in the room.

23 Claims, 7 Drawing Sheets

FIG. 7
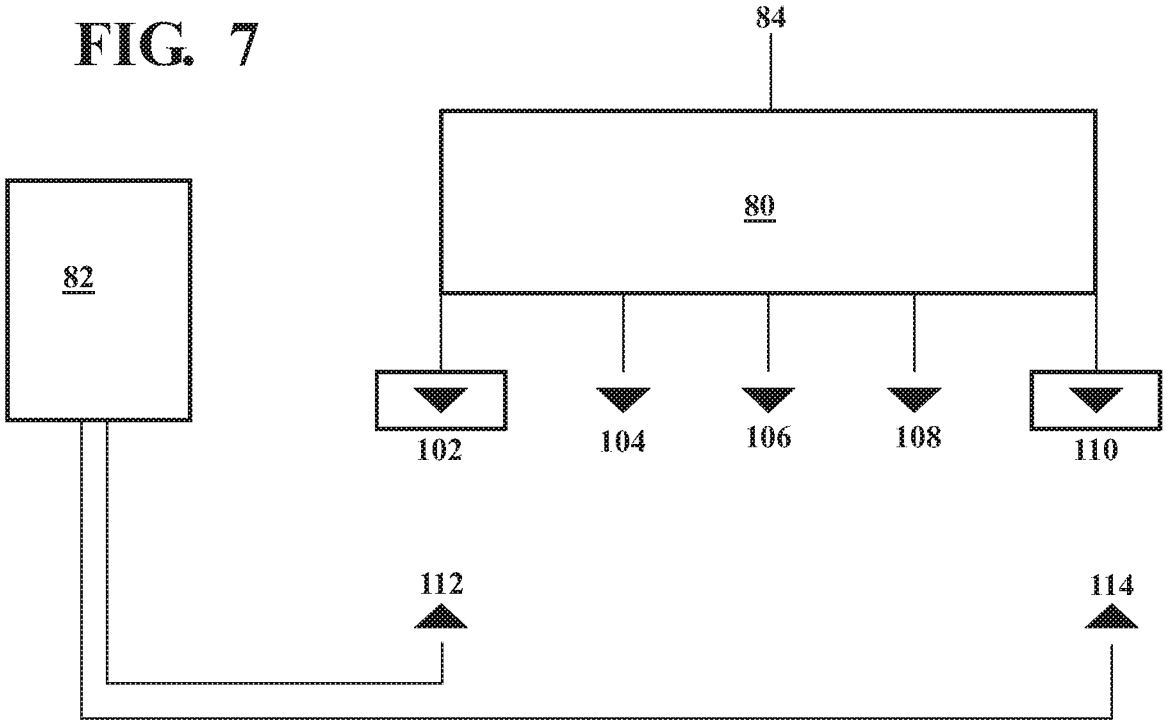
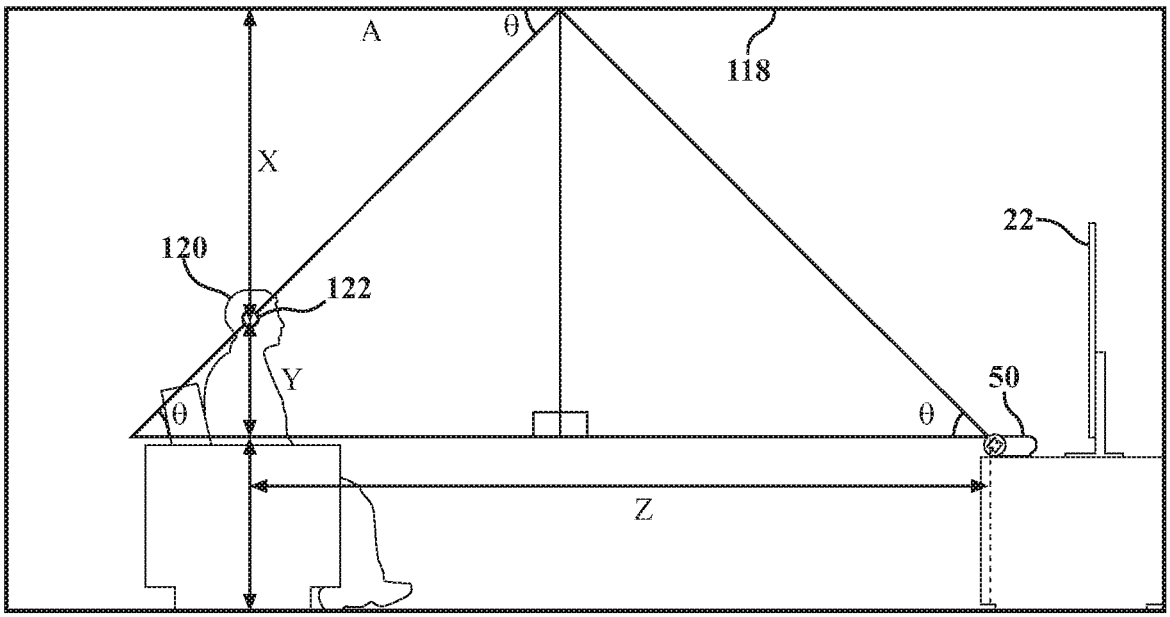
FIG. 8

SOUND SYSTEM WITH AUTOMATICALLY ADJUSTABLE RELATIVE DRIVER ORIENTATION

CROSS-REFERENCE TO RELATED APPLICATIONS

This application claims the benefit of U.S. Provisional Patent Application No. 62/789,964, filed on Jan. 8, 2019, the entirety of which is hereby incorporated by reference.

TECHNICAL FIELD

This disclosure relates generally to sound systems featuring multiple speakers whose drivers may be automatically adjusted to vary the relative orientations between the drivers, and more specifically, the relative rotational orientations of the driver median axes.

BACKGROUND

Advances in audio technology have led to the development of home theater sound systems that seek to replicate the experience of watching a movie in a theatre. In such systems, sound is propagated in all three dimensions, with speakers in front of, behind, and overhead of the listener. The sound is encoded into digital audio source signals which are subsequently decoded into multiple channels. Each channel is an independent electrical signal that may be amplified and transmitted to one or more speaker drivers. The speaker drivers are transducers that convert the electrical signals into sound waves and may be placed at different locations and/or in different orientations throughout the listening area. Drivers include woofers, tweeters, and subwoofers, each of which has a different frequency response. A channel's electrical signal may be fed to multiple drivers and selectively filtered to make maximum use of each type of driver's frequency response.

Home systems have been developed to replicate the theater experience, and some systems include overhead speakers. However, overhead speakers can be unwieldy or unattractive in the home. In certain cases, ceilings are too high to make their use practical.

To simulate the use of overhead speakers, "reflected sound" or "up-firing" speakers have been developed. "Up-firing" speakers are those in which the median axis of the speaker driver is not parallel to the floor or other surface the speaker rests on. Up-firing speakers are located at or near ground level and include up-firing drivers, i.e., drivers facing straight up (sometimes referred to as "top firing") or at an upward facing angle relative to a horizontal plane (such as the plane defined by a floor, table, the Earth, or a bottom surface of the up-firing speaker housing). In limiting cases with top-firing drivers, the median axis of the driver is perpendicular to the floor and/or the ceiling. However, in other cases the median axis is oriented at an angle that intersects the ceiling at a desired point of reflection. In some cases, the up-firing speakers are provided in a "soundbar" which is a lengthwise array of speakers. The soundbar may comprise part of a sound system that includes speakers firing in directions different than the up-firing speakers, and the content of the audio signals provided to the various channels associated with each speaker may be varied to achieve a desired listening experience. The sound bar may also be used in connection with separate speakers such as a subwoofer or satellite speakers placed behind the listener.

In known sound systems with up-firing speakers, the various speakers comprising the system have drivers that are oriented in different directions relative to one another. For example, the median axis of front firing speakers will be substantially parallel to a plane defined by the Earth, whereas the median axis of up-firing speakers will typically be oriented at angle that is not parallel to the Earth but which is from greater than zero degrees to 90 degrees relative to the plane defined by the Earth. The up-firing speakers will also typically be associated with their own audio channels.

However, in known sound systems that include up-firing speakers, the relative orientations between the speaker drivers are typically not adjustable. In addition, if a particular movie or program lacks up-firing content, the up-firing speakers are typically not used.

Dolby's ATMOS® technology uses up-firing speakers with a fixed degree of up-firing relative to a horizontal reference plane and any associated forward-firing speakers. Instead of encoding the digital sound data to a specific channel, ATMOS® audio signal content typically includes a metadata file that defines the assignment of the audio signal data to channels during decoding. Some of the ATMOS® channels may be up-firing channels depending on the desires of the specific content creator. One scenario in which up-firing content would be used is one in which the listener would expect sounds to emanate from overhead, such as airplane sounds.

As mentioned previously, the reason for providing up-firing speakers is to simulate overhead speakers and deliver sounds to the listener's ears from above. This requires rotating the up-firing speakers by an angle of rotation that ensures that the emitted sound will reflect off of the ceiling and travel to the listener's ears. However, especially in larger rooms and/or rooms with higher ceilings, the position of the listener relative to the sound system may vary, causing the optimum angle of rotation to vary as well.

It is desirable to provide a speaker system in which the relative orientations of the speaker drivers comprising the system are automatically adjustable, in particular, to a user selected angle of rotation between the up-firing and forward-firing speakers or based on the position of the listener relative to the sound system and/or the room geometry.

Thus, a need has arisen for a sound system that addresses one or more of the foregoing issues.

SUMMARY

In accordance with the first aspect of the present disclosure, a sound system is provided. The sound system comprises a plurality of speakers, wherein a relative orientation between a first subset of speakers in the plurality of speakers and a second subset of speakers in the plurality of speakers is automatically adjustable.

In accordance with a first example, the sound system comprises at least one up-firing audio channel and at least one forward-firing audio channel, the second subset of speakers comprises at least one adjustable up-firing speaker operatively connected to the at least one up-firing audio channel, and the first subset of speakers comprises at least one forward-firing speaker operatively connected to the at least one forward-firing channel.

In the same or other examples, the relative orientation is an angle of rotation that is dynamically adjustable. In certain implementations, the sound system is configured to calculate a desired angle of rotation for the adjustable up-firing speakers based on at least one of room geometry information and listener location information.

In the same or other examples, the system further comprises a computer readable medium having executable instructions stored thereon, wherein when executed by the processor, the computer executable instructions cause a motor controller to rotate the second subset of speakers about a rotational axis relative to the first subset of speakers when up-firing content is detected in an audio source signal operatively connected to the processor. In the same or other implementations, the listener can set the angle of rotation of the at least one adjustable up-firing speaker to a desired value.

In accordance with another aspect of the present disclosure, a method of operating a sound system comprising a plurality of speakers is provided. The method comprises receiving an audio source signal, detecting up-firing content in the audio source signal, automatically adjusting an orientation of a second subset of speakers in the plurality of speakers relative to a first subset of speakers in the plurality of speakers, and transmitting an up-firing content signal corresponding to the up-firing content to the second subset of speakers. In a first example, the method further comprises receiving a first distance value for a first distance from the sound system to a listener and a second distance value for a second distance from the sound system to a ceiling, and calculating an angle of rotation between the second subset of speakers and the first subset of speakers, wherein the step of automatically adjusting the orientation of the second subset of speakers relative to the first subset of speakers comprises rotating the second subset of speakers about a rotational axis to the calculated angle of rotation.

BRIEF DESCRIPTION OF THE DRAWINGS

FIG. 7 is a block diagram of the sound system of FIG. 4 shown in use with a separate subwoofer connected to satellite speakers;

FIG. 8 is a schematic used to illustrate the dynamic calculation of an up-firing angle of rotation for use with the sound systems described herein.

DETAILED DESCRIPTION

Figure 1:
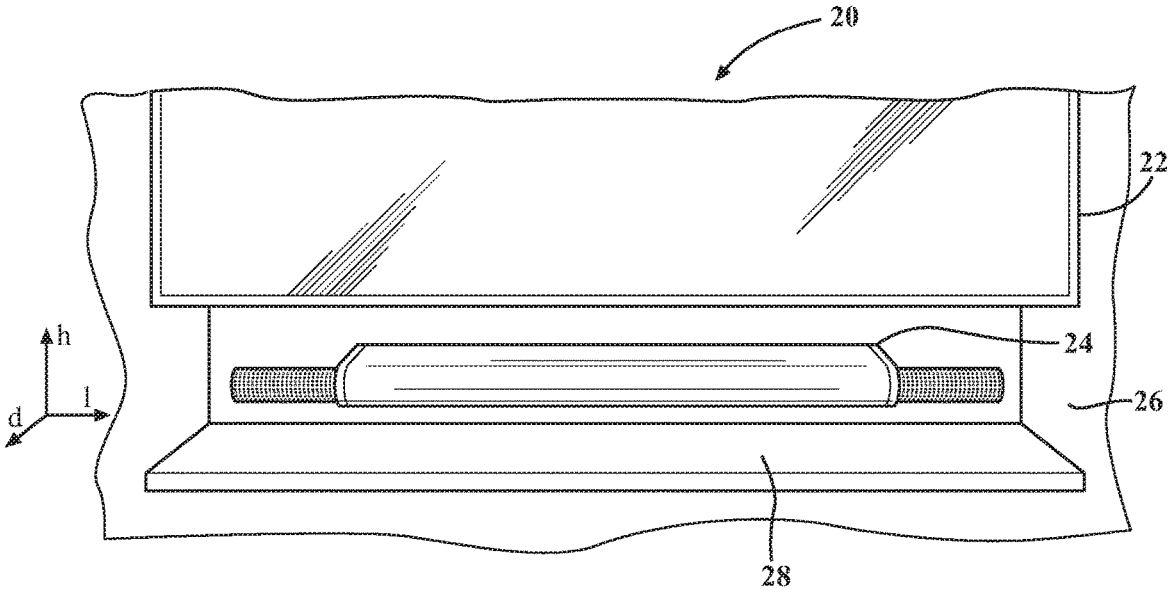
FIG. 1 is a front elevational view of an audio-visual system comprising a visual display and a first example of a sound system in accordance with the present disclosure.

As discussed below, the present disclosure provides sound systems with a set of speakers which may be automatically adjusted to different rotational orientations relative to one another to provide a desired listening experience. Certain known systems, such as those using Dolby ATMOS® technology, provide different audio data from an audio data stream or signal to differently oriented speakers in order to enhance the listening experience. However, the orientations of the various known speakers are not individually adjustable by the user. For example, one subset of speakers may be oriented with the median axes of their drivers aimed toward the ceiling ("up-firing") while other subsets may be oriented with the median axes of their drivers parallel to the ceiling and the floor ("front firing" or "side firing"). Different sound data from an audio signal may be provided to the different speakers to enhance the listening experience. As used herein, the term "subset" refers to a speaker or set of speakers with orientations that are adjusted in a common fashion with one another, or for which their orientations are not adjusted.

As used herein, the term "up-firing speaker" refers to a speaker with a fixed or adjustable up-firing driver. The term "speaker" means one or more drivers in a unitary enclosure. Speakers may include up-firing, front-firing, downward firing, and/or side-firing drivers. They may also include frequency specific drivers such as woofers, tweeters, subwoofers, and full-range drivers.

The term "driver" means a single electroacoustic transducer that produces sound in response to an electrical audio input signal. Typical speaker drivers include cone, horn, and ribbon transducer speaker drivers. The driver includes a median axis which is a reference axis used to gauge the spatial distribution of sound from the driver. If the median axis points upward (i.e., has a positive angle relative to a horizontal plane such as would be defined by a floor), the speaker is said to be "up-firing." In a limiting case, the positive angle is ninety degrees upward relative to the horizontal plane, in which case the up-firing speaker is said to also be "top firing." One commercially available audio platform that is designed to utilize up-firing speakers is the Dolby Atmos® platform.

Front-firing and side-firing drivers project their sound in different (but sometimes overlapping) directions in the horizontal plane. Their median axes are typically substantially parallel to the horizontal plane or close enough to parallel that they could not intersect the ceiling of the room in which the speakers are placed. The "horizontal plane" is typically defined by a floor in the room in which the sound system is provided. However, there is typically some surface of the sound system housing that is a resting surface that sits on a floor, table, cabinet, etc. That resting surface will have a planar portion that serves as a reference plane and which is typically parallel to the floor, tabletop, cabinet, etc. upon which the sound system sits. In the case of a wall-mounted sound system, the median axes of the front-firing and side-firing drivers are typically perpendicular to the wall on which the sound system is mounted.

Referring to FIG. 1 an audio-visual system 20 is shown. Audio visual system 20 includes a visual display 22 and a sound system 24, which are spaced apart along a vertical room height axis h. In FIG. 1 sound system 24 is mounted on wall 26 but could also rest on shelf 28.

Sound system 24 comprises a sound bar that includes a plurality of speakers 30, 32, and 34 which are adjacent one another along a length axis l. Sound system 24 includes HDMI input(s) and at least one HDMI ARC output (discussed below). Speaker 30 comprises a first subset of the plurality of speakers and speakers 32 and 34 comprise a second subset (or respective second and third subsets) of the plurality of speakers. Because the speaker 30, 32, and 34 enclosures are cylindrical, they also define a radial axis r. Although not depicted, sound system 24 also includes a processor (not shown) and a computer readable memory (not shown) within housing 40 which have computer executable instructions stored thereon. When executed by the processor, the computer executable instructions cause adjustable up-firing drivers within the plurality of speakers 30, 32, and 34 to rotate relative to front-firing drivers within the plurality of speakers 30, 32, and 43. The rotation may be triggered by the processor detecting up-firing content from an audio source signal. Alternatively, or in addition, the rotation may be triggered by a user action, such as by depressing a button on a remote control or on housing 40 of sound system 24. The processor also executes a decoder program for decoding audio source signal data as well as other known components such as digital to analog converters and power amplifiers for converting the decoded data to electrical signals transmitted to the drivers of speakers 30, 32, and 34.

End speakers 32 and 34 are spaced apart from one another along the sound system 24 length axis l and are separated by central sound bar speaker 30. Each speaker 30, 32, and 34 may have one or more drivers along the length axis l. End speakers 32, 34 have drivers located behind perforations 42 and 44 in their respective cylindrical enclosures 41, 43. Central sound bar speaker 30 has similar perforations that are covered by a cloth. The central sound bar speaker 30 may include one or more drivers. In certain examples, right, center, and left front-firing drivers are included, each of which corresponds to an independent sound system 24 audio channel. In the same or other examples, each end speaker 32, 34 also corresponds to its own respective up-firing audio channel. The nature of the sounds transmitted by each driver are dictated by the particular audio source signal being played and the manner in which the content creator chose to distribute it as among the various audio channels.

Power button 46 activates the sound system 24. A remote control may also be provided with a power button. The length of the sound system 24 along the length axis l is defined by the spacing between first length axis end 36 and second length axis end 38. A base 45 is also provided to allow for resting the sound system 24 on a tabletop or other horizontal surface. Base 45 is also configured to allow for mounting the sound system 24 on a wall 26 as shown in FIG. 1. Speakers 32 and 34 are preferably made of a rigid material such as a metal or plastic as is housing 40 and base 45.

Figure 2A:
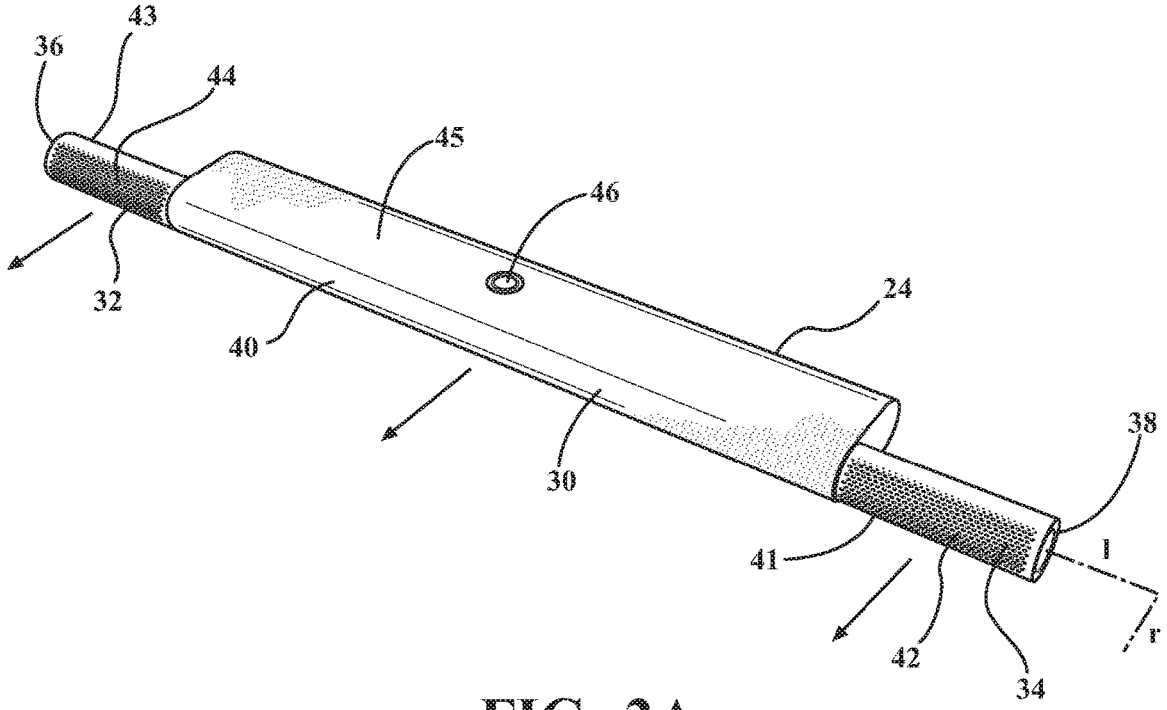
FIG. 2A is a top perspective view of the sound system of FIG. 1.

As mentioned above, each speaker 30, 32, and 34 includes a unitary enclosure that may enclose one or more drivers. As used herein, the "orientation" of a speaker refers to the rotational orientation of the median axes of its drivers (or of any one driver). In certain examples, the axis of rotation is defined by the axis along which the various drivers are arranged. The arrows in FIG. 2A indicate that the median axes of the drivers in speakers 32 and 34 are parallel to the floor and bottom surface 48 of base 45 and are thus in a "front firing" orientation. The central sound bar speaker 30 is also in a front firing orientation, and therefore the median axes of its drivers are also parallel to the bottom surface 48 of base 45.

Unlike known sound systems, sound system 24 allows for automatic adjustment of the relative orientation of the median axes of the drivers in the various speakers 30, 32, and 34. In particular, the cylindrical housings 41, 43 of end speakers 32 and 34 are rotatable about the lengthwise axis l of sound system 24 to rotate their respective drivers about a rotational axis parallel to the sound system 50 lengthwise axis l. This rotation adjusts the orientation of the median axes of their respective drivers relative to the median axes of the drivers in central sound bar speaker 30. Each cylindrical housing 41, 43 of end speakers 32 and 34 is operatively connected to a motor that rotates the housing 41, 43 and the drivers within it about the sound system 24 length axis l.

Figure 3A:
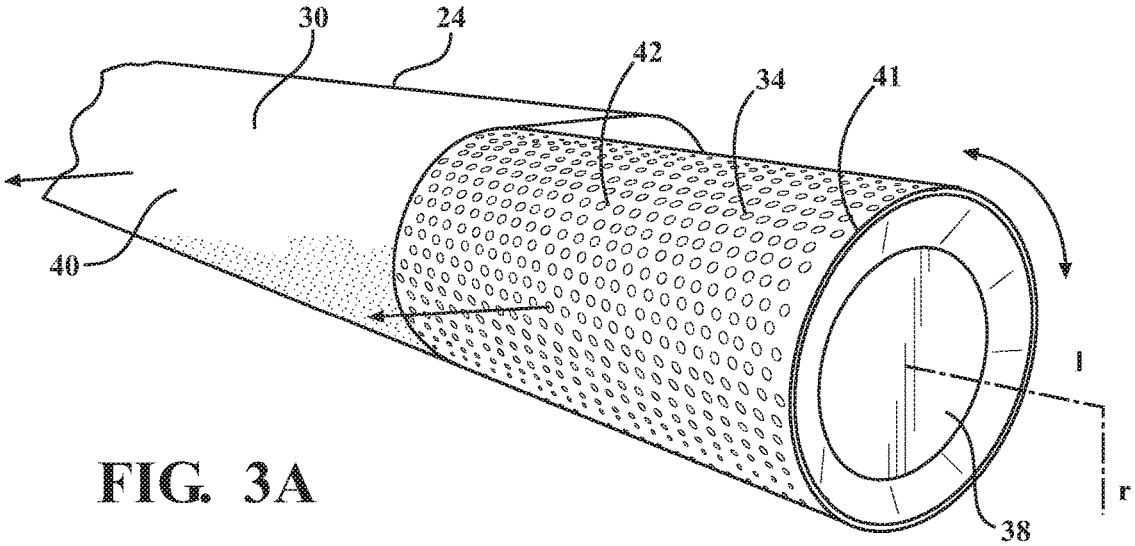
FIG. 3A is a partial end perspective view of the sound system of FIG. 1 with the end speaker shown in a first rotational orientation about a rotational axis parallel to the lengthwise axis of the sound system.
Figure 3B:
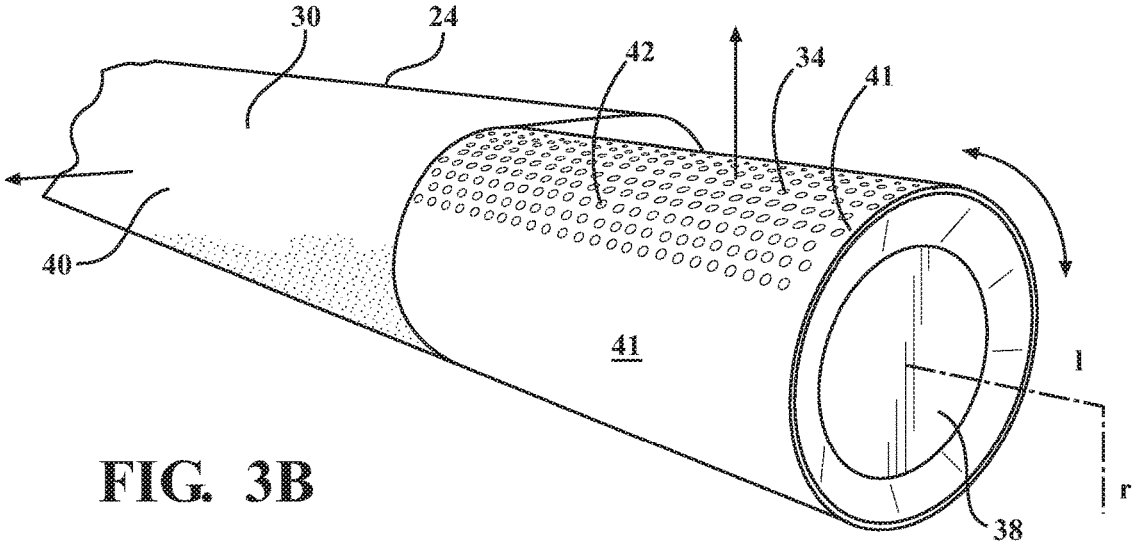
FIG. 3B is a partial end perspective view of the sound system of FIG. 1 with the end speaker shown in a second rotational orientation about the rotational axis.

FIGS. 3A and 3B show two different rotational orientations between the end speakers 32, 34 and the central sound bar speaker 30. In FIG. 3A, the end speakers 32, 34 are oriented in the same direction as the central sound bar speaker 30 so that the median axes of the drivers in each speaker 30, 32, and 34 are parallel (speaker 32 is not visible in FIG. 3A). In FIG. 3B the end speakers 32, 34 are rotated relative to the central sound bar speaker 30 so that the median axes of the former are perpendicular to the median axes of the latter. If the bottom 48 of sound system 24 is on a surface parallel to the floor and/or earth, speakers 32 and 34 would be said to be in a front firing orientation in FIG. 3A and an up-firing orientation in FIG. 3B.

The relative angles between the median axes of the speaker drivers in speakers 32 and 34 and those in speaker 30 may be a variety of angles other than 0 degrees and 90 degrees. In addition, the up-firing and front firing orientations may be reversed. For example, if sound system 24 is wall mounted with its central sound bar speaker 30 oriented so that its driver median axes face upward toward a ceiling (or the sky) (either straight upward or at an angle), then speaker 30 would be said to be in an "up-firing" orientation. In that case, speakers 32 and 34 could be rotated so that their driver median axes are in a front firing orientation. Also, speakers 32 and 34 could be configured to rotate sideways (toward and away from central sound bar speaker 30) or to rotate through 360 degrees. They could also be rotated differently from one another. However, in the illustrated examples, they are rotated in synchronization with one another. In other examples, some speakers may be adjustable through various side firing angles while others may be adjustable through various upward firing angles.

A variety of known angular orientation detector technologies may be used to determine the orientation of the driver median axes of speaker 30 and speakers 32 and 34 relative to a reference plane. For example, gyroscopes may be used. In addition, accelerometers may be used alone or in combination with gyroscopes. Alternatively, mechanical stops may be provided to define a reference rotational orientation for speakers 32 and 34. Switches may also be provided which are activated when the stops are reached to indicate to any programs executed by the processor that the speakers 32, 34 have reached a reference orientation used as the basis for any subsequent rotation. The motor actuation increments may be correlated to angular rotations so that the speakers 32 and 34 may be rotated to a specified degree of rotation without actually measuring or sensing that degree of rotation.

The sound system 24 also preferably has any necessary computer executable instructions stored on its computer readable medium for performing audio processing calculations and determining the angular orientations of the end speakers 32 and 34. The motors used to rotate end speakers 32 and 34 also preferably include controllers which receive actuation signals from the processor to rotate the end speakers 32 and 34 about the rotation axis.

As mentioned previously, in certain known systems, speakers with different orientations are provided (e.g., up-firing and top firing), and different audio data is provided from an audio signal to the differently oriented speakers. For example, in a war movie, it may be desirable to hear airplanes from overhead, in which case airplane sounds may come from an up-firing speaker instead of a front firing speaker. In certain examples, the audio signal or the data carried by it are used to determine whether the recipient sound system is one in which multiple speaker orientations are used. For example, if the audio source signal data is associated with speaker orientation data, that would indicate that the intended sound system is one with multiple speaker orientations. In other examples, the audio source signal data may associate particular audio data with particular channels, some of which are up-firing channels, which tells the processor to rotate the end speakers 32 and 34 to a desired degree of rotation about the axis of rotation (which is parallel to the lengthwise axis l).

Figure 2B:
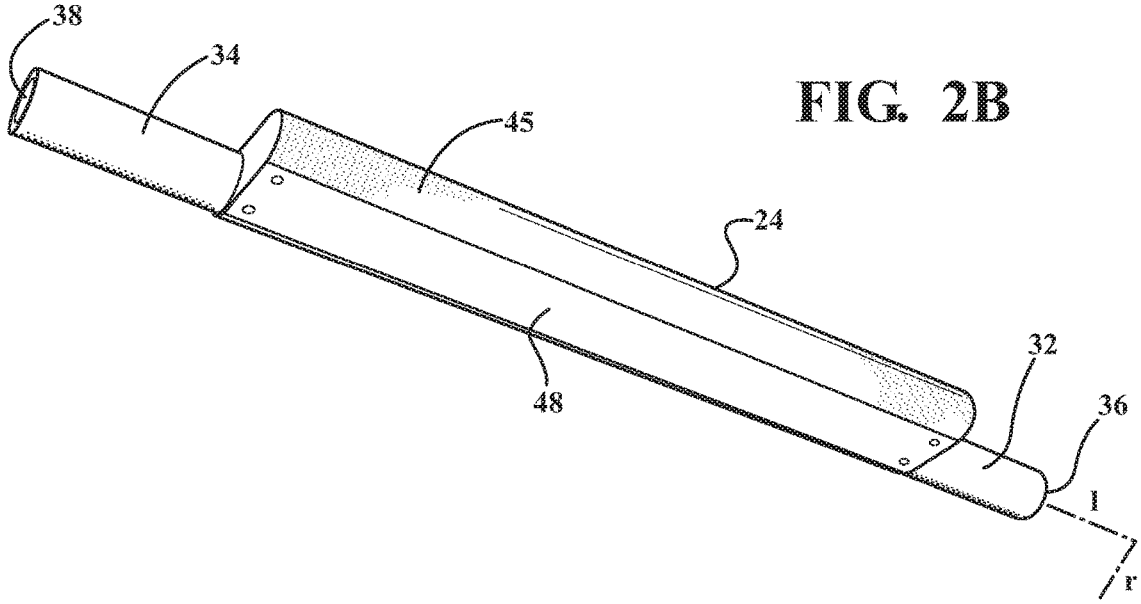
FIG. 2B is a bottom perspective view of the sound system of FIG. 1.
Figure 2C:
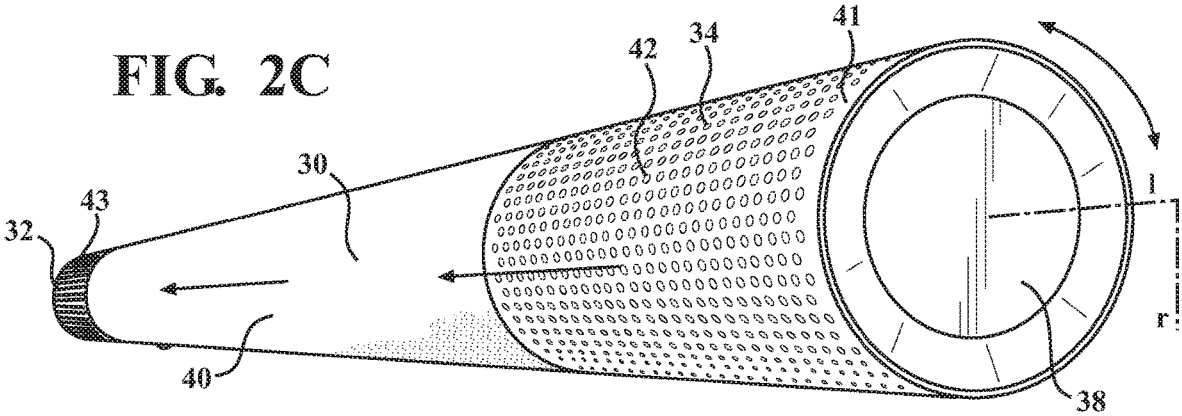
FIG. 2C is an end perspective view of the sound system of FIG. 1.

If such multiple speaker orientations are used, then the relative orientations of the speakers may be adjusted to a default configuration in which different speakers are oriented differently. In one example, the configuration of FIG. 2B may be the default configuration, or if the central speaker 30 is in an up-firing orientation, the end speakers 32 and 34 may be rotated to a front firing orientation.

In one example, sound system 24 receives audio source signal data that is digitally encoded to one or more channels, each of which is operatively connected to one or more drivers within the various speakers 30, 32, 34. When the decoder decodes the audio source signal data, the processor will detect whether any audio data is associated with the channels operatively connected to adjustable up-firing speakers 32 and 34. If such data is detected, the processor will issue commands to the motor controllers associated with speakers 32 and 34 to rotate them about a rotation axis parallel to the lengthwise axis l to a specified degree of rotation relative to the front-firing center speaker 30. In one example, the specified degree of rotation is not user adjustable and is preferably from about 60 to about 80 degrees, more preferably from about 65 to about 85 degrees, and still more preferably from about 68 to about 72 degrees upward relative to the median axes of center speaker 30. In another example, and as described further below, the specified degree of rotation is dynamically determined by the sound system 24 based on a first distance along a horizontal axis from the speakers 32 and 34 to a listener in a room and/or a second distance along a vertical axis from the speakers 32 and 34 to the room's ceiling. An assumed or user-entered vertical distance from the ceiling to the user's ears may also be used. In accordance with the example, computer executable instructions are stored on the sound system's computer readable medium, and when executed by a processor, the instructions cause the processor to calculate a degree of rotation of the adjustable up-firing speakers 32, 34 relative to the center speaker 30. Details of the dynamic calculation are described further below with reference to FIG. 8. In addition, at least one transmitter may be provided to transmit a first distance determination signal from the sound system 24 to the listener and a second distance determination signal from the sound system to the ceiling of the room. A sensor provided on a remote control held by the listener may receive the first distance determination signal, and a sensor on the sound system 24 may receive the second distance determination signal after it is reflected from the ceiling. Using known distance calculation techniques, the time it takes for the sensors to receive the signals may be used to determine the first and second distances. Signals such as ultrasonic and infrared signals may be used as the first and second distance determination signals.

Referring to FIGS. 4-6B, a second example of a sound system 50 in accordance with the present disclosure is provided. Sound system 50 includes center speaker 54, right-end adjustable up-firing speaker 56, and left-end adjustable up-firing speaker 58. Each speaker 54. 56. 58 includes one or more drivers. The center speaker 54 is a first subset of speakers in the plurality of speakers 54, 56, 58 and is forward-firing. The right-end speaker 56 and left-end speaker 58 comprise a second subset (or respective second and third subsets) of the plurality of speakers 54, 56, 58 and are each adjustably rotatable relative to center speaker 54 about an axis of rotation parallel to the lengthwise axis l of the sound system 50. Sound system 50 also includes the appropriate connectors to receive and transmit standard digital video and audio signals, including HDMI signals. Housing 52 includes a top surface 53 and a bottom surface 55 spaced apart along a vertical axis perpendicular to the lengthwise axis l as well as a rear curved surface 57. Each speaker 54, 56, and 58 has a corresponding cylindrical enclosure 73, 75, 79 which houses one or more drivers. Collectively, the cylindrical enclosures 73, 75, 79 define a speaker enclosure with a unitary appearance. However, the end enclosures 73 and 79 may rotate with their corresponding drivers relative to central enclosure 75. As shown in FIGS. 5A and 5B, the bottom surface 55 of housing 52 serves as a horizontal reference plane and is typically substantially parallel to the floor or a tabletop.

Sound system 50 is preferably connected to receive an audio source signal such as that included in an HDMI signal from a smart TV, or a DVD or Blu-ray video signal. The term "audio source signal" includes audio data with content directed to forward-firing speakers and upward-firing speakers, as well as any metadata defining channel assignments for the audio data.

Sound system 50 needs to receive the audio source signal (including the up-firing content and forward-firing content) separated from any accompanying video signals. In one example known as "HDMI ARC" (HDMI "audio return channel") the sound system 50 sends HDMI signals to the TV, and the TV returns the audio signal portion thereof to the sound system 50. The sound system 50 may receive HDMI signals from Blu-ray players, DVD players, or cable boxes. If the TV is streaming HD video, it may receive the HD video signal from an Internet router and then transmit the audio signal portion to the sound system 50. In a preferred example, the sound system 50 receives Dolby ATMOS® audio source signals which may include both up-firing and forward-firing content.

Figure 5A:
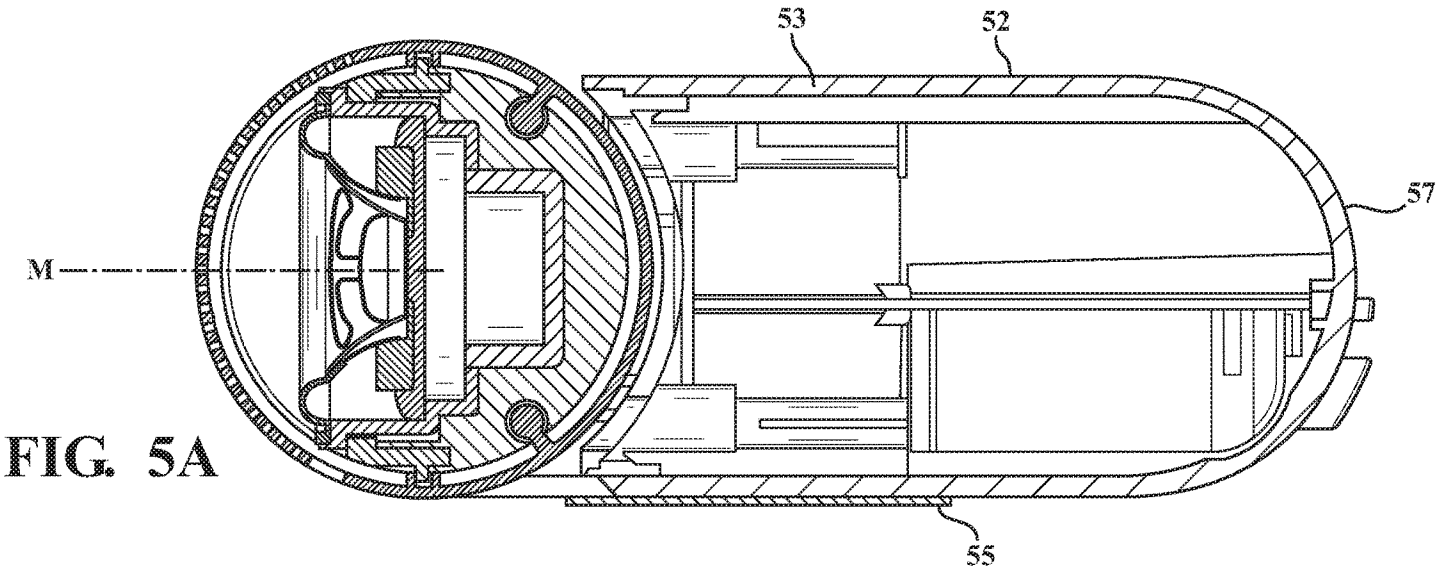
FIG. 5A is a cross-sectional view of a right up-firing channel, full-range driver of the sound system of FIG. 4 in a forward-firing orientation defined by an angle of rotation θ.
Figure 5B:
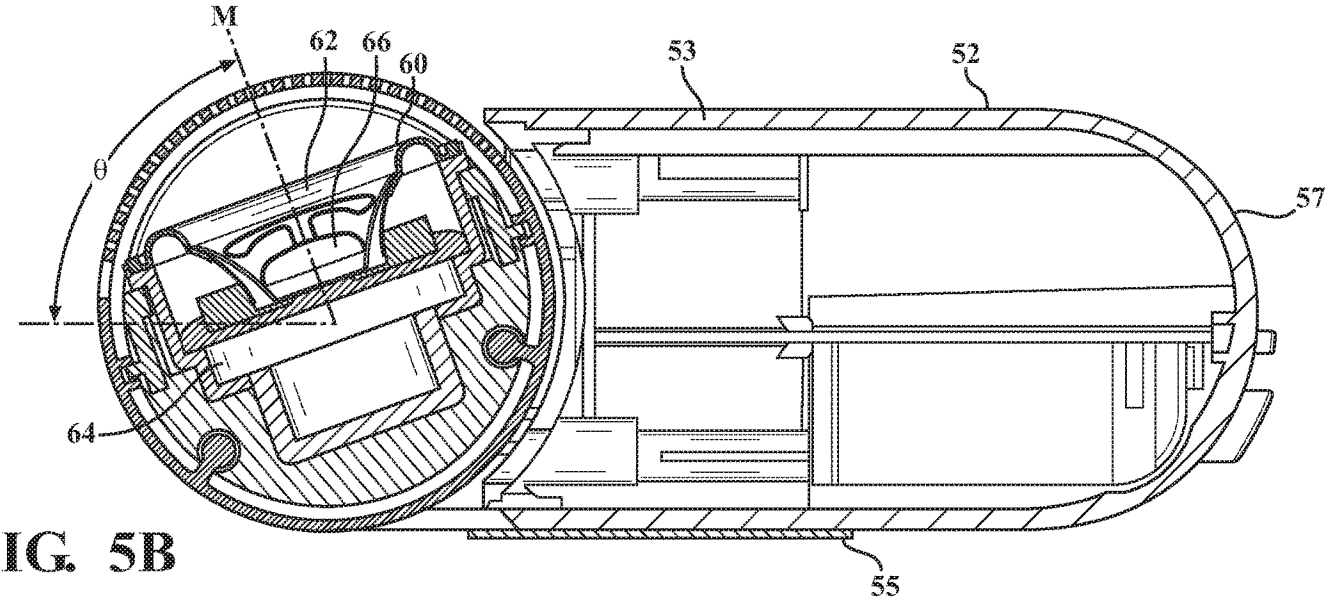
FIG. 5B is a cross-sectional view of the right up-firing channel full-range driver of the sound system of FIG. 5A in an upward-firing orientation.
Figure 6A:
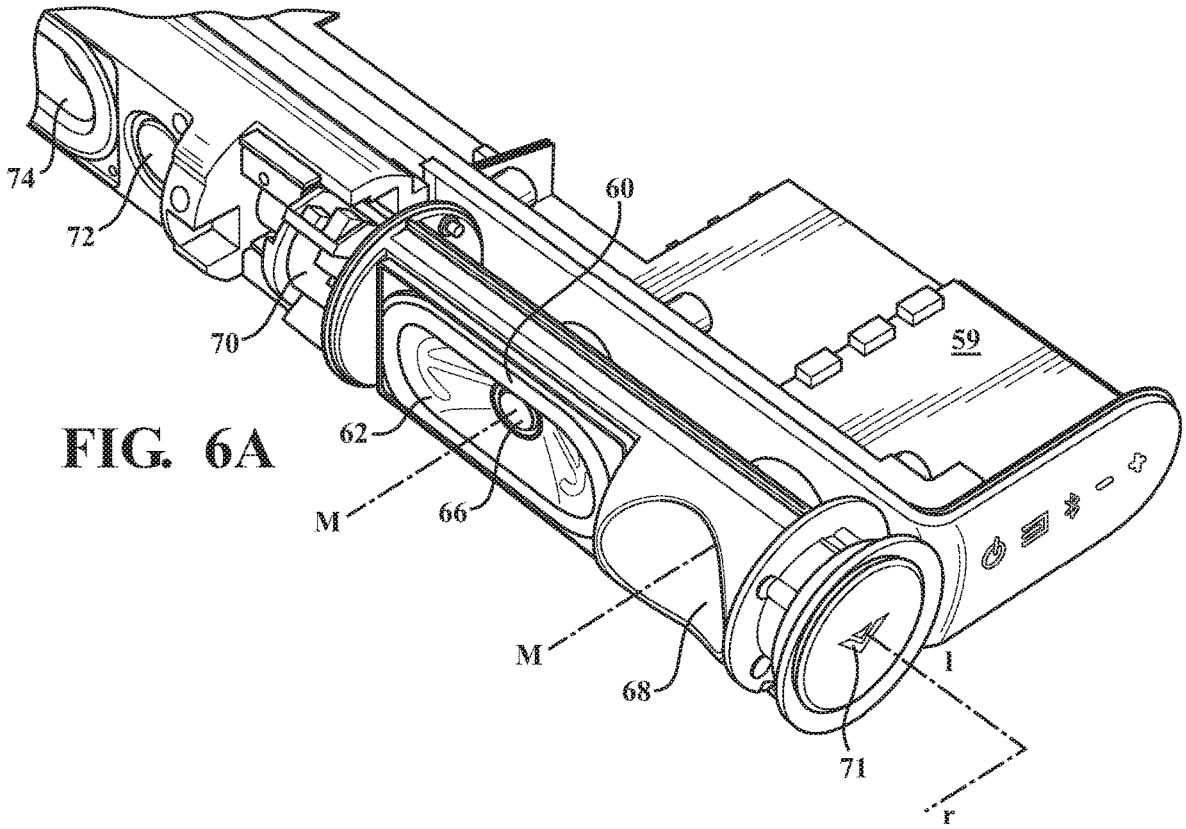
FIG. 6A is a partial perspective view of the sound system of FIG. 4 with the housing removed in which the right up-firing channel, full-range speaker and woofer are in a forward-firing orientation.
Figure 6B:
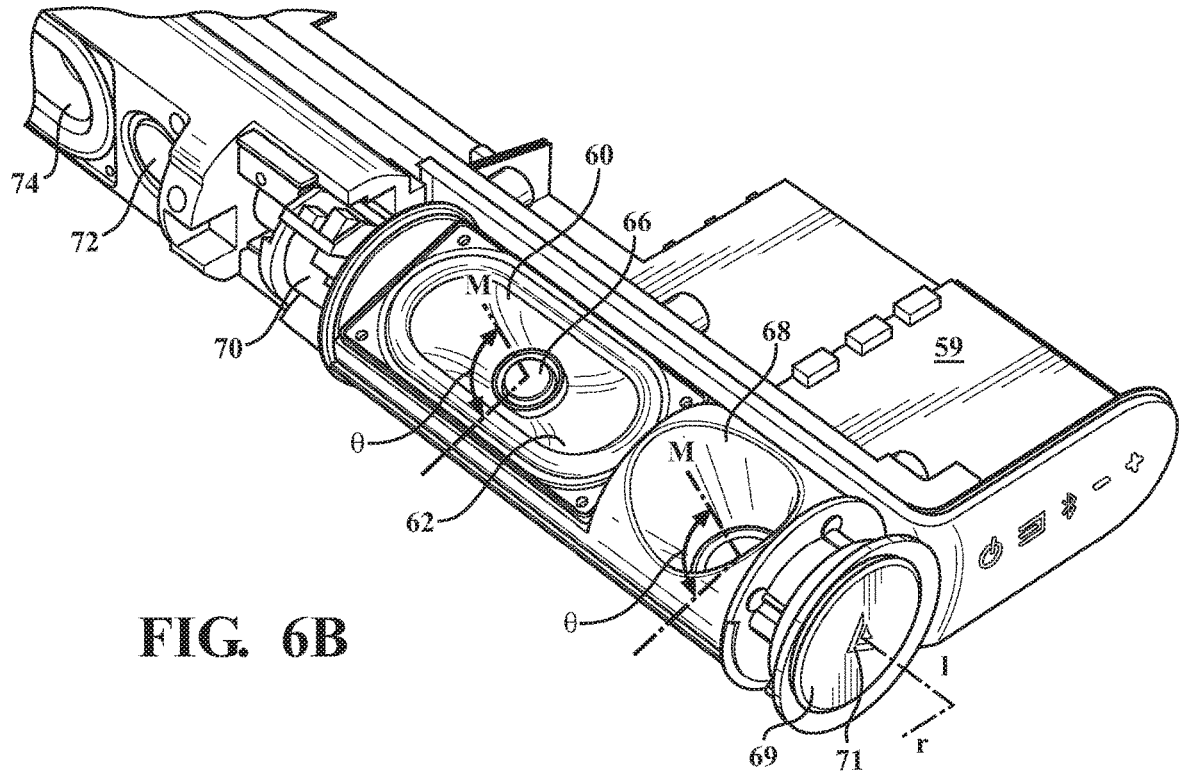
FIG. 6B is a partial perspective view of the sound system of FIG. 4 with the housing removed in which the right up-firing channel full-range speaker and woofer are in an up-firing orientation.

Referring to FIGS. 5A-5B and 6A-6B, right end speaker 56 includes two adjustable up-firing drivers 60 and 68. FIGS. 6A and 6B show a partial right view of the sound system 50 with housing 52 removed. FIGS. 5A and 5B show a cross-section of driver 60. Driver 60 comprises a cone 62, a magnet and coil assembly 64, and a cap 66.

Driver 60 is a full-range driver, and driver 68 is a woofer. The left end adjustable up-firing speaker 58 is configured similarly but is not shown in FIGS. 5A-5B or 6A-6B. The housing 52 is removed in FIGS. 6A and 6B. However, drivers 60 and 68 have median axes M, which are parallel to the bottom housing surface 55 in FIG. 6A. Thus, in FIG. 6A the drivers 60 and 68 are in a forward-firing orientation. In FIG. 5A driver 60 is in a forward-firing orientation.

In FIGS. 6A and 6B, a portion of drivers 72, 74 comprising center speaker 54 is shown. Although not illustrated, in the example of FIGS. 4-6B, center speaker 54 comprises three-pairs of full-range drivers and associated woofers.

Up-firing drivers 60 and 68 are automatically adjustable to a rotational orientation relative to the drivers comprising center speaker 54 and relative to the bottom surface 55 of housing 52. Motor 70 is located adjacent to driver 60 and is operatively connected to drivers 60 and 68. Thus, motor 70 is operable to change the rotational orientation of drivers 60 and 68 about a rotational axis parallel to the length axis l of the sound system 50 relative to housing bottom surface 55 and the center speaker 54 drivers. A motor controller (not shown) is operatively connected to the motor and to a processor in housing 52 such that the processor can transmit signals to the motor controller to rotate the drivers 60, 68 to a desired degree of rotation relative to the forward-firing drivers in center speaker 54. An end-cap 69 with a position indicating logo 71 on it also rotates with the drivers 60, 68. The orientation of the logo corresponds to the rotational orientation of drivers 60, 68. A similar end-cap may be provided on the opposite end of the sound system 50 for indicating the rotational orientation of the left end adjustable up-firing speaker 58 adjustable up-firing drivers. Rear enclosure 59 houses acoustic cavities and circuit boards.

FIGS. 5B and 6B show the right end speaker adjustable up-firing drivers 60 and 68 in an up-firing orientation with their median axes rotated upward relative to the bottom housing surface 55. The degree of rotation is represented by an angle of rotation θ relative to the plane of bottom housing surface 55, which is also the degree of rotation of their median axes relative to those of the drivers comprising center speaker 54.

In certain examples, the right-end speaker 56 and left-end speaker 58 are rotatable to a fixed degree of rotation. In other words, either the speaker is in a forward-firing orientation or a single up-firing orientation. In certain such examples, θ is fixed and ranges from about 60 to about 80 degrees, preferably from about 65 to about 75 degrees, and more preferably from about 68 to about 72 degrees. In some examples, the user can determine whether to rotate the right-end speaker 56 and left-end speaker 58 to an up-firing orientation using a remote control or controls on the sound system housing 52. At the same time, or alternatively, a program resident in sound system 50 detects whether an audio source signal includes up-firing content (i.e., content that the content creator designated for use with an up-firing speaker). The detection of up-firing content may be carried out by determining whether any content has been assigned to up-firing channels. If up-firing content is present, the program causes the motor 70 controller to rotate the drivers 60 and 68 to an up-firing orientation, and the up-firing content designated for drivers 60 and 68 is converted to corresponding up-firing content electrical signals and transmitted to drivers 60 and 68, while up-firing content designated for drivers comprising left-end speaker 58 is converted to corresponding up-firing electrical signals and transmitted to its drivers (not shown).

FIG. 7 is a schematic used to illustrate the operation of sound system 50. Processor 80 is provided and is operatively connected to one or more computer readable media (not shown). The computer readable media have executable programs stored on them which, when executed by processor 80, decode an audio source signal 84 (e.g., as extracted from an HDMI signal) into channel-specific audio data. Conventional components including digital to analog converters and amplifiers provide electrical signals for channels 102-110 which are transmitted to corresponding speaker drivers, including drivers 60, 68, 72, and 74. FIG. 7 shows channels 102-110, but omits the components between the processor and the speakers. The channels 102-110 in FIG. 7 represent the result of the decoding process at the processor before the conversion to channel-specific electrical signals transmitted to their corresponding drivers 60, 68, 72, 74, etc.

Figure 4:
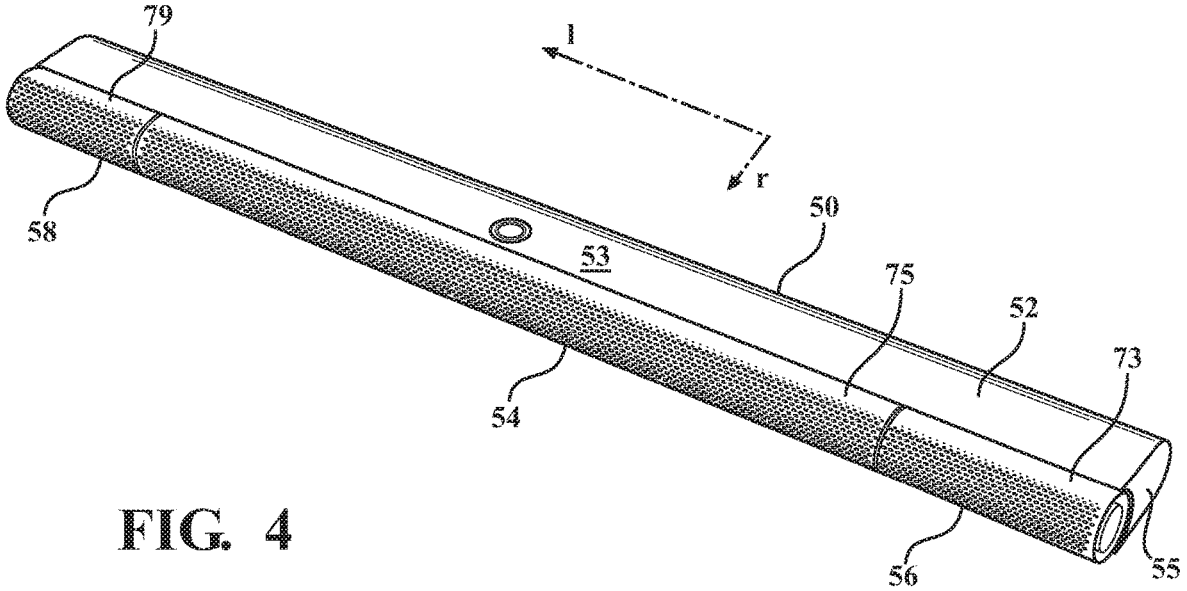
FIG. 4 is a perspective view of a second example of a sound system in accordance with the present disclosure.

Channels 102 and 110 are left and right up-firing channels. Channel 102 is connected to the drivers in adjustable up-firing left-end speaker 58 (FIG. 4). Channel 110 is connected to adjustable up-firing drivers 60, 68 in right-end speaker 56. Channel 104 is a left channel that is connected to two left-channel, front-firing drivers not shown in center speaker 54. Channel 108 is a right channel that is connected to drivers 72 and 74 (FIGS. 6A and 6B) in center speaker 54. Channel 106 is a center channel connected to two drivers in center speaker 54. The drivers connected to channels 102, 104, 106, and 108 in the example of FIG. 4-6B are all pairs of full-range drivers and woofers. However, other types of drivers and combinations thereof may be used.

Subwoofer system 82 may also be provided and used with sound system 50. In the example of FIG. 7, subwoofer system 82 is not hardwired to sound system 50, but rather, receives signals wirelessly from sound system 50, such as via Bluetooth. The subwoofer system 82 includes a subwoofer driver (not separately shown), but also includes a wireless signal receiver (e.g., a Bluetooth-enabled receiver) and components for converting decoded audio data received via Bluetooth to electrical signals, and then to corresponding sounds. The subwoofer driver produces sound of a fairly narrow wavelength band such as all or a portion of the 20-200 kHz range.

Satellite speakers 112 and 114 are typically placed behind the listener, and subwoofer 82. In addition to converting its own decoded audio data to electrical signals and ultimately to sound, the subwoofer 82 converts the decoded audio signals for the satellite speakers 112 and 114 into electrical signals and transmits the electrical signals to the satellite speakers 112 and 114 through wired connections.

In certain examples, the sound system 50 is configured to dynamically determine the angle of rotation θ of the up-firing drivers 60, 68, etc. relative to the front-firing drivers. Up-firing drivers are used to simulate overhead speakers, and the ideal degree of up-firing depends on the room geometry and the position of the listener relative to the up-firing drivers. In certain implementations, the sound system 50 is preferably configured to determine the angle of rotation θ based on one or more of the distance of the up-firing drivers from the room ceiling along a vertical axis, the distance of the up-firing drivers from the listener along a horizontal axis, and a distance from the listener's ear to the up-firing drivers along the vertical axis.

Referring to FIG. 8 a listener 120 is seated in a chair at a horizontal distance z from the adjustable up-firing drivers in sound system 50 (such as drivers 60, 68). The desired angle of rotation θ is one that will cause sound transmitted from the up-firing drivers to reflect off of ceiling 118 and toward the ears 122 of listener 120. As is known in the art, sound waves reflect off a surface at an angle of reflection that equals the angle of incidence. Referring to FIG. 8, the horizontal distance from the up-firing drivers is represented as the variable z. The vertical distance from the adjustable up-firing drivers 60, 68, etc. to the ceiling 118 is x+y, where x is the distance from the user's ear to the ceiling along the vertical axis, and y is the distance from the up-firing drivers to the listener's ears along the vertical axis. The horizontal distance from the listener to the point of reflection from the ceiling may be represented as the variable A and calculated as follows:

$$A=x(\tan\theta) \tag{1}$$

where, x=distance from the listener's ear to the ceiling along the vertical axis (m or ft.);

y=distance from the listener's ears to the up-firing drivers along the vertical axis (m or ft.);

z=distance from the up-firing drivers to the listener along the horizontal plane;

A=distance from the listener's ears to the point of reflection along the horizontal axis (m or ft.);

θ=desired angle of rotation of up-firing driver median axes (radians).

$$\tan\theta = \frac{x+y}{z-A} \tag{2}$$

Equation (1) may be substituted for the variable A in equation (2) to yield:

$$\theta = \tan^{-1}\left(\frac{2x+y}{z}\right) \tag{3}$$

Thus, in the case of a listener sitting z=10 feet from the sound system 50 in a room with an x+y=15 foot ceiling, where the listener's ear is y=2 feet above the soundbar, $$x\colon\ \theta = \tan^{-1}\frac{2(13\text{ ft})+2\text{ ft}}{10\text{ ft}} = 1.23\text{ rad} = 70.3\text{ degrees.}$$

The sound system 50 preferably has a computer readable medium with instructions stored thereon which, when executed by processor 80, carry out the foregoing calculations. In one implementation, the sound system includes a program that generates a user interface on a connected visual display, and the listener can enter values for x, y, and z. In another implementation, the listener can go to a website that is linked to sound system 50 and input values for x, y, and z.

In another example, sound system 50 is configured to determine values for x, y, and z. For example, sound system 50 may include a transmitter configured to transmit a horizontal distance determination signal from sound system 50 to a remote control held by the listener. The remote control would have a receiver or sensor for receiving the transmitted horizontal distance determination signal. The remote would be configured to allow the user to initiate the transmission of the distance determination signal. A program resident on a computer readable medium in the remote control or in the sound system 50 would be executed by the corresponding processor to determine the elapsed time between the transmission and the receipt of the horizontal distance determination signal, and would use known techniques to determine a value for the horizontal distance from the upward firing drivers 60, 68 (and those comprising part of left-end speaker 58 drivers) to determine the elapsed time between the transmission of the signal and the receipt of the signal by the remote.

At the same time, or in another example, the sound system 50 is configured to transmit a vertical distance determination signal to ceiling 118. A transmitter may be provided on housing 52 to transmit the signal. The signal would reflect off the ceiling and downward to a sensor also placed on housing 52. A remote control could be configured to initiate the transmission. Known distance determination signals may be used, for example, ultrasonic or infrared signals. In this case, the elapsed time between transmission and sensing would correspond to 2(x+y). In another implementation, the remote control would be configured to generate a vertical distance determination signal by being placed proximate the listener's ear and activated to initiate the signal. A sensor on the remote would determine when the reflected signal is received. The elapsed time would correspond to 2x and would be used to calculate the value of y based on the previously determined value of x+y. Alternatively, the user could enter a value for y in the manner described above for entering manual values of x, y, and z.

Figure 9:
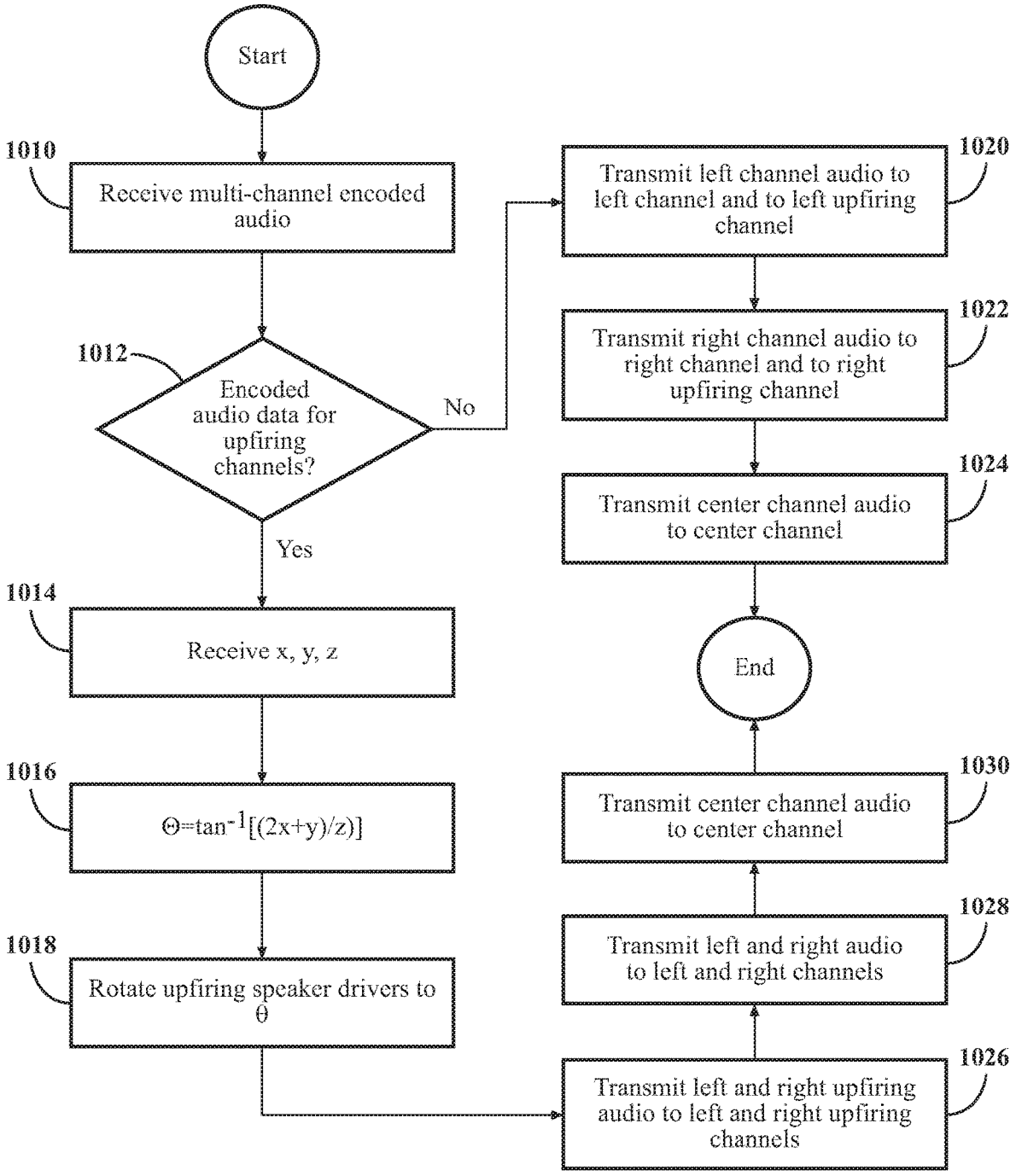
FIG. 9 is a flow diagram depicting a method of processing an audio source signal that may include up-firing content for use with the sound systems described herein.

A method of using a sound system such as system 50 to play audio content will now be described with reference to FIG. 9. In accordance with the method, an audio source signal 84, such as an HDMI ARC signal, is received by sound system 50. The assignment of data to particular channels may be done as part of the encoding process or by way of a separate file that associates different content with different channels, as is the case with Dolby ATMOS® (step 1010). In one preferred example, a sound system such as sound system 50 transmits an HDMI signal to a smart TV, and using HDMI ARC, the TV transmits the audio portion of the HDMI back to the sound system 50.

In step 1012 the processor 80 determines if the incoming audio data in audio source signal 84 (FIG. 7) includes any up-firing channel content, i.e., content intended to be played through a speaker oriented at an up-firing angle relative to the horizontal plane. If no such content is present in step 1012 (i.e., returns a value of NO), the content designated for left channel 104 may be transmitted to both left channel 104 and left up-firing channel 102, left up-firing channel 102 alone, or left channel 104 alone. However, in step 1020 in FIG. 9, the content is sent to both the left channel 104 and the left up-firing channel 102 for transmission to the drivers corresponding to those channels. However, in any of these cases, because no up-firing content is provided, the left up-firing drivers in left end adjustable up-firing speaker 58 are not rotated relative to the drivers in center speaker 54 and instead remain in a forward-firing rotational orientation. Similarly, if step 1012 returns a value of NO, the content designated for right channel 108 is transmitted to drivers 60, 68, 72, and 74, to drivers 60 and 68 only, or to drivers 70 and 72 only. However, the right up-firing drivers 60, 68 are not rotated relative to drivers 72 and 74 or any of the other forward-firing drivers comprising center speaker 54. If at the outset of performing the method of FIG. 9, the right and left up-firing drivers are rotated relative to the drivers of the center speaker 54, then in steps 1020 and 1022, the drivers would be rotated back to an "unrotated" orientation, i.e., their median axes would be parallel to those of the drivers in center speaker 54 (including drivers 72 and 74 in FIGS. 6A and 6B).

Content designated for the center channel 106 is transmitted to that channel in step 1024 and ultimately to a center driver in center speaker 54. In certain examples, when up-firing content is first detected, the left and right end adjustable up-firing speakers 56, 58 will rotate to the desired degree of rotation and will remain rotated for the duration of the program or movie being watched. However, at any given time, the adjustable up-firing speakers 56, 58 may not play any audio if at that given time, there is no up-firing audio content in the audio source signal. Thus, the up-firing speakers 56, 58 are preferably rotated no more than once during the playing of any one piece of content as opposed to being rotated back and forth as the presence of up-firing content varies.

If the audio source signal 84 includes up-firing content, in step 1014 the processor 80 receives values for x, y, and z as defined with respect to FIG. 8, such as by retrieving them from memory. In step 1016 the angle of rotation of the up-firing drivers 60, 68 and those in left-end speaker 58 are calculated using equations (1)-(3). In step 1018 the controllers associated with motor 70 and with a counterpart motor for the drivers in left-end speaker 58 are activated to rotate the drivers to the calculated value of θ. The ability to dynamically vary the angle of rotation θ may be particularly useful in large rooms in which the distance z between the listener 120 and the sound system 50 may fluctuate significantly. Alternatively, a fixed value of θ may be used.

In step 1026 the left and right channel up-firing content is transmitted to its respective channels 102 and 110. In steps 1028 and 1030 content designated for the left, center, and right channels 104, 106, and 108 is transmitted to those channels and ultimately to their corresponding drivers, which in the case of channel 108 are drivers 72 and 74.

In step 1018, the method may further include detecting a current rotational orientation of the drivers comprising left end and right end adjustable up-firing speakers 56 and 58 so that the final angle of rotation is equal to θ. This would be particularly useful if the sound system 50 were configured to allow the user to specify an angle of rotation because in that event the method of FIG. 9 may start out with the left and right-end speakers in an up-firing rotational orientation. At that point, rotating by the full amount θ will cause the final degree of rotation to vary from the desired degree of rotation. As mentioned previously, accelerometers and gyroscopes may be used to determine the current rotational orientation relative to the horizontal plane and to the median axes of the forward-firing drivers in the center speaker 54.

Alternatively, mechanical stops may be provided which limit the range of rotation of the up-firing drivers 60, 68 (and those of left end adjustable up-firing speaker 58). A switch may be provided and positioned to be activated when the stops are reached. When the stops are reached a switch may be activated to indicate to processor 80 that the end of travel has been reached so that the closing of the switch will correspond to a defined rotational orientation. Any subsequent rotation would then be carried out using that end of travel orientation as a reference orientation. In that case, if the method of FIG. 9 starts out with the left and right end adjustable up-firing speakers in an up-firing orientation, the left and right end adjustable up-firing speakers would be rotated to the end of travel position before carrying out step 1018.

What is claimed is:

1. A sound system comprising:

a plurality of speakers, wherein a relative orientation between a first subset of speakers in the plurality of speakers and a second subset of speakers in the plurality of speakers is automatically adjustable;

a motor operatively connected to the second subset of speakers, a motor controller operatively connected to the motor, and a processor operatively connected to the motor controller; and a computer readable medium having executable instructions stored thereon, wherein when executed by the processor, the computer executable instructions cause the motor controller to rotate the second subset of speakers about a rotational axis relative to the first subset of speakers when up-firing content is detected in an audio source signal operatively connected to the processor, wherein the sound system comprises a sound bar having a length defining a length axis, the first subset of speakers and the second subset of speakers are adjacent one another along the length axis, and the rotational axis is parallel to the length axis.

2. The sound system of claim 1, wherein each speaker in the plurality of speakers comprises a driver having a median axis, the second subset of speakers in the plurality of speakers is automatically adjustable to vary an angle of rotation defined by the median axes of the drivers in the second subset speakers relative to an angle defined by the median axes of the drivers in the first subset of the plurality of speakers.

3. The sound system of claim 2, wherein the system is configured to dynamically adjust the angle of rotation between the median axes of the second subset of speakers and the median axes of the first subset of speakers.

4. The sound system of claim 1, wherein the sound system comprises at least one up-firing audio channel and at least one forward-firing audio channel, the second subset of speakers comprises at least one adjustable up-firing speaker operatively connected to the at least one up-firing audio channel, and the first subset of speakers comprises at least one forward-firing speaker operatively connected to the at least one forward-firing audio channel.

5. The sound system of claim 4, wherein the at least one up-firing audio channel comprises a right up-firing audio channel and a left up-firing audio channel, the at least one adjustable up-firing speaker comprises at least one right adjustable up-firing speaker and at least one left adjustable up-firing speaker, the at least one right adjustable up-firing speaker is operatively connected to the right up-firing channel, and the at least one left adjustable up-firing speaker is operatively connected to the left up-firing channel.

6. The sound system of claim 5, wherein the at least one forward firing speaker comprises a center forward firing speaker, the at least one forward firing audio channel comprises a center forward firing audio channel, and the center forward firing audio channel is operatively connected to the center forward-firing speaker.

7. The sound system of claim 5, wherein the at least one right adjustable up-firing speaker comprises a right up-firing woofer and a right full-range speaker, and the at least one left adjustable up-firing speaker comprises a left up-firing tweeter and a left full-range speaker woofer.

8. The sound system of claim 1, wherein the speakers in the plurality of speakers each have a driver with a respective median axis, and when executed by the processor, the computer executable instructions calculate a desired angle of rotation between the median axes of the first subset of speakers and the second subset of speakers.

9. The sound system of claim 8, wherein the desired angle of rotation between the median axes of the first subset of speakers and the second subset of speakers is calculated based on a first distance along a horizontal axis from the second subset of speakers to a listener and a second distance along a vertical axis from the second subset of speakers to a ceiling.

10. The sound system of claim 1, further comprising a remote control operable to rotate the second subset of speakers relative to the first subset of speakers.

11. The sound system of claim 10, wherein the remote control is operable to rotate the second subset of speakers relative to the first subset of speakers to a user-specified angle of rotation.

12. A sound system comprising:

a plurality of speakers, wherein a relative orientation between a first subset of speakers in the plurality of speakers and a second subset of speakers in the plurality of speakers is automatically adjustable;

a motor operatively connected to the second subset of speakers, a motor controller operatively connected to the motor, and a processor operatively connected to the motor controller;

a computer readable medium having executable instructions stored thereon, wherein when executed by the processor, the computer executable instructions cause the motor controller to rotate the second subset of speakers about a rotational axis relative to the first subset of speakers when up-firing content is detected in an audio source signal operatively connected to the processor; and at least one transmitter operable to transmit a first distance determination signal to the listener and a second distance determination signal to the ceiling, wherein the speakers in the plurality of speakers each have a driver with a respective median axis, and when executed by the processor, the computer executable instructions calculate a desired angle of rotation between the median axes of the first subset of speakers and the second subset of speakers, and wherein the desired angle of rotation between the median axes of the first subset of speakers and the second subset of speakers is calculated based on a first distance along a horizontal axis from the second subset of speakers to a listener and a second distance along a vertical axis from the second subset of speakers to a ceiling.

13. The sound system of claim 12, further comprising a remote control with a first receiver operable to receive the first distance determination signal.

14. The sound system of claim 13, further comprising a second receiver operable to receive the second distance determination signal.

15. A sound system comprising:

a plurality of speakers, wherein a relative orientation between a first subset of speakers in the plurality of speakers and a second subset of speakers in the plurality of speakers is automatically adjustable;

a motor operatively connected to the second subset of speakers, a motor controller operatively connected to the motor, and a processor operatively connected to the motor controller;

a computer readable medium having executable instructions stored thereon, wherein when executed by the processor, the computer executable instructions cause the motor controller to rotate the second subset of speakers about a rotational axis relative to the first subset of speakers when up-firing content is detected in an audio source signal operatively connected to the processor, the speakers in the plurality of speakers each have a driver with a respective median axis, and when executed by the processor, the computer executable instructions calculate a desired angle of rotation between the median axes of the first subset of speakers and the second subset of speakers, and wherein the desired angle of rotation between the median axes of the first subset of speakers and the second subset of speakers is calculated based on a first distance along a horizontal axis from the second subset of speakers to a listener and a second distance along a vertical axis from the second subset of speakers to a ceiling, and wherein the sound system is operable to receive a user input value for at least one of the first distance and the second distance.

16. A sound system comprising:

a plurality of speakers, wherein a relative orientation between a first subset of speakers in the plurality of speakers and a second subset of speakers in the plurality of speakers is automatically adjustable, and wherein the sound system comprises at least one forward-firing channel operatively connected to the first subset of speakers and at least one upward firing channel operatively connected to the second subset of speakers, and when the sound system receives an audio source signal having forward-firing content and no up-firing content, the forward-firing content is transmitted to the at least one upward firing channel and the second subset of speakers is not rotated relative to the first subset of speakers.

17. The sound system of claim 16, wherein the sound system comprises a sound bar having a length defining a length axis, and the first subset of speakers and the second subset of speakers are adjacent one another along the length axis.

18. A method of operating a sound system comprising a plurality of speakers, comprising:

detecting up-firing content in an audio source signal;

automatically adjusting an orientation of a second subset of speakers in the plurality of speakers relative to a first subset of speakers in the plurality of speakers;

transmitting an up-firing content signal corresponding to the up-firing content to the second subset of speakers, receiving a first distance value for a first distance from the second subset of speakers to a listener and a second distance value for a second distance from the second subset of speakers to a ceiling; and calculating an angle of rotation between the second subset of speakers and the first subset of speakers, wherein the step of automatically adjusting the orientation of the second subset of speakers relative to the first subset of speakers comprises rotating the second subset of speakers about a rotational axis to the calculated angle of rotation, wherein the step of calculating an angle of rotation between the second subset of speakers and the first subset of speakers comprises calculating an angle of rotation θ between median axes of drivers in the second subset of speakers relative to median axes of drivers in the first subset of speakers in accordance with the following relationship:

$$\theta=\tan^{-1}[(2x+y)/z]$$

where, θ=angle of rotation (radians) of the median axes of the drivers in the second subset of speakers relative to the median axes of the drivers in the first subset of speakers;

x=vertical distance (feet) from listener's ears to a ceiling y=vertical distance (feet) from the drivers in the second subset of speakers to the listener's ears; and z=horizontal distance (feet) from the drivers in the first subset of speakers to the listener.

19. The method of claim 18, further comprising:

transmitting a horizontal distance detection signal from the sound system to a listener at a location;

sensing the horizontal distance detection signal at the location.

20. The method of claim 19, further comprising:

transmitting a vertical distance detection signal from the sound system to a ceiling, thereby creating a reflected vertical distance detection signal;

sensing the reflected vertical distance detection signal; and determining a horizontal distance from the listener to the sound system and a vertical distance from the sound system to the ceiling based on the sensed horizontal distance detection signal and the sensed reflected vertical distance detection signal.

21. The method of claim 18, wherein the step of automatically adjusting an orientation of a second subset of speakers in the plurality of speakers relative to a first subset of speakers in the plurality of speakers comprises rotating the second subset of speakers upward relative to the first subset of speakers.

22. The method of claim 21, wherein the step of rotating the second subset of speakers upward relative to the first subset of speakers comprises rotating the second subset of speakers upward by about seventy degrees (1.22 radians).

23. A method of operating a sound system comprising at least one up-firing channel operatively connected to at least one adjustable up-firing speaker and at least one forward-firing channel operatively connected to at least one forward-firing speaker, the method, comprising:

receiving an audio source signal comprising forward-firing content;

determining if the audio source signal includes up-firing audio content;

transmitting up-firing audio content to the at least one adjustable up-firing speaker via the at least one up-firing channel if the audio source signal includes up-firing audio content; and transmitting the forward-firing content to the at least one adjustable up-firing speaker via the at least one up-firing channel if the audio source signal does not include any up-firing audio content.

* * * * *